United States Patent [19]

Downey

[11] Patent Number: 4,742,437

[45] Date of Patent: May 3, 1988

[54] WATER BED ILLUMINATOR

[76] Inventor: Rick Downey, 131st & 88th Ave., Palos Park, Ill. 60464

[21] Appl. No.: 807,005

[22] Filed: Dec. 9, 1985

[51] Int. Cl.[4] ..... F21V 33/00

[52] U.S. Cl. ..... 362/130; 362/234; 5/451

[58] Field of Search ..... 5/451, 308, 400, 2 R; D6/507, 382; 362/130, 311, 351, 127, 134, 234, 253, 101, 801; D26/51

[56] References Cited

U.S. PATENT DOCUMENTS

| | | | |
|---|---|---|---|
| 845,441 | 2/1907 | Vaughan | 362/101 |
| 1,760,301 | 5/1930 | Dougherty | 362/130 |
| 2,418,877 | 4/1947 | Gustafson | 362/130 |
| 3,746,835 | 7/1973 | Yu | 5/451 |
| 3,761,974 | 10/1973 | Kuss | 5/451 |
| 4,220,984 | 9/1980 | Truher | 5/451 |
| 4,507,816 | 4/1985 | Smith, Jr. | 5/451 |

*Primary Examiner*—E. Rollins Cross
*Assistant Examiner*—D. M. Cox
*Attorney, Agent, or Firm*—Thomas J. Ring

[57] ABSTRACT

A water bed illuminator in which the bed includes a rectangular box-like base having a longitudinally extending central support wall spaced equidistantly from each opposite side wall, and three laterally extending support walls spaced apart equidistantly between each opposite end wall, to form six separate compartments. A light fixture is placed in the center of each compartment, connected to an electric power source by an insulated conductor, with an electric switch connected therein to turn the lights on and off. A mattress box is positioned on the base, having a floor in which six holes are cut at locations which are in registration with respective ones of the light fixtures. The waterbed mattress comprises a transparent or translucent water tight rectangular container which forms a mattress when filled with water. When placed in the mattress box and the light fixtures are turned on, the mattress becomes illuminated. Three holes are also formed in each side wall of the base in registration with respective ones of the light fixtures to provide light on each side of the bed. The holes may be covered with colored lens to transmit colored light both through the side walls and to illuminate the mattress.

17 Claims, 3 Drawing Sheets

WATER BED ILLUMINATOR

BACKGROUND OF THE INVENTION

This invention relates to the field of water beds, and lighting apparatus to illuminate the same.

Prior art devices of this kind do not provide a plurality of spaced apart light sources to more uniformly illuminate the bed and at the same time function as a night light by providing illumination through the side walls of the base of the water bed. Neither do the prior art devices permit the use of different color lens to provide a mixture of colored light since they do not include a plurality of light sources.

Examples of prior art devices include that disclosed in U.S. Pat. No. 4,220,984, which provides a single lighting fixture positioned at one end of the bed. U.S. Pat. No. 4,133,024 discloses a transparent container having a single light source mounted in a reflector large enough to span one side wall and attempt to achieve better light dispersion by that means. U.S. Pat. No. 3,908,598 discloses a transparent aquarium having a single lighting fixture, but one that is elongated, such as a flourescent bulb, extending across the top wall to achieve better light dispersion throughout the transparent enclosure by use of a single elongated bulb. U.S. Pat. No. 3,746,835 discloses heating apparatus to heat the water in a water bed, in which heat lamps are placed below the water mattress. However, a metal plate 33 has to be placed between the heat lamps and the transparent water mattress to guard against rupture. Such plate obviously blocks out and prevents any light from the heat lamps reaching the water mattress. U.S. Pat. No. 2,290,866 discloses a single light fixture under the foot end of an ordinary bed, not to illuminate the mattress (which is an ordinary non-transparent fabric and spring type of mattress) but to provide indirect low level lighting of the bedroom floor. U.S. Pat. No. 1,760,301 discloses heating apparatus for a baby's bassinet, in which incandescent light bulbs are the heat source enclosed in a chamber under the mat on which the baby lays.

SUMMARY OF THE INVENTION

It is an object of the invention to provide a waterbed having a plurality of lighting fixtures spaced apart beneath the transparent water mattress.

It is an object of the invention to provide a waterbed having a plurality of lighting fixtures which serve simultaneously to illuminate the transparent water mattress and to illuminate each side of the bed thereby providing a night light for the room.

DESCRIPTION OF PREFERRED EMBODIMENT

Figure 1:
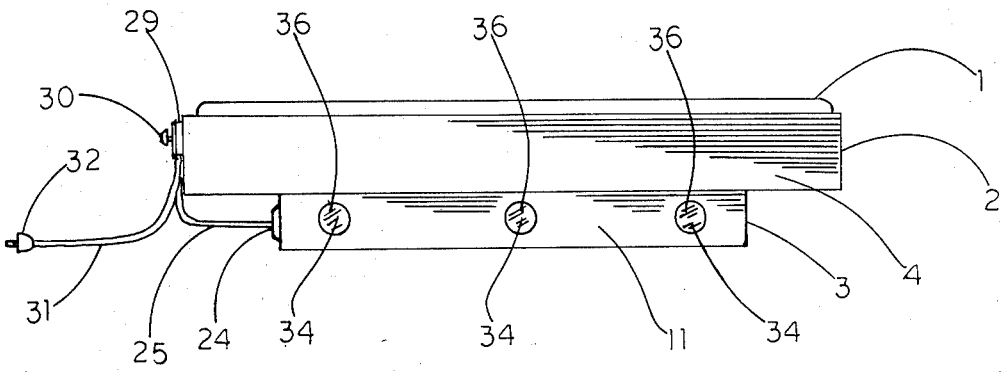
FIG. 1 is a side elevation view of a water bed having illuminating means in accordance with this invention.
Figure 2:
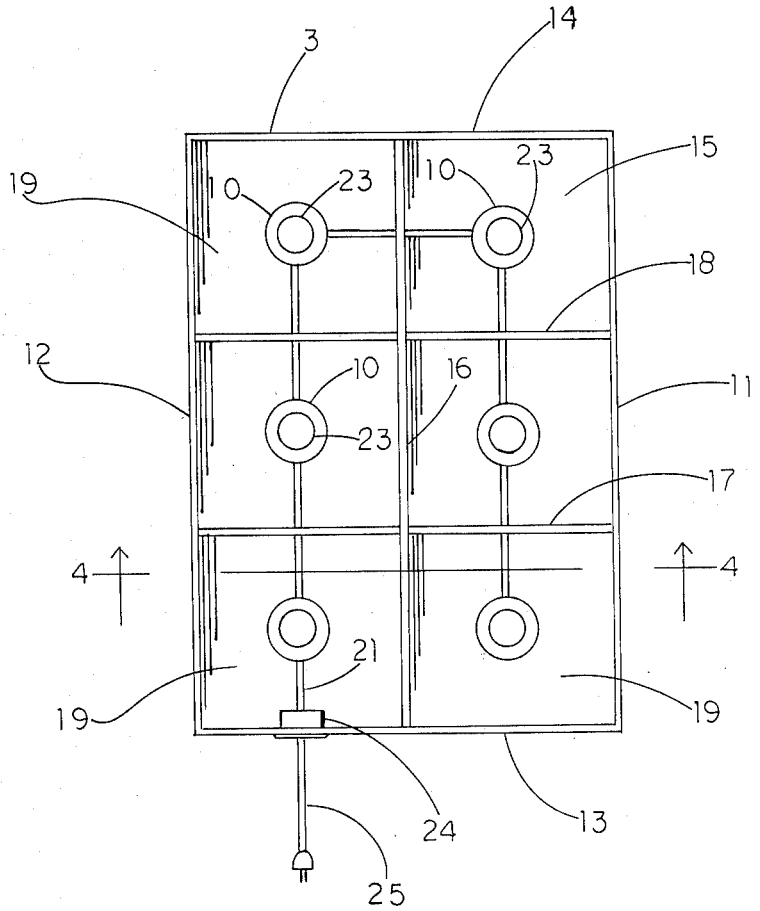
FIG. 2 is a top plan view of the rectangular base of the water bed shown in FIG. 1, showing the lighting fixtures at their respective spaced apart locations therein.
Figure 3:
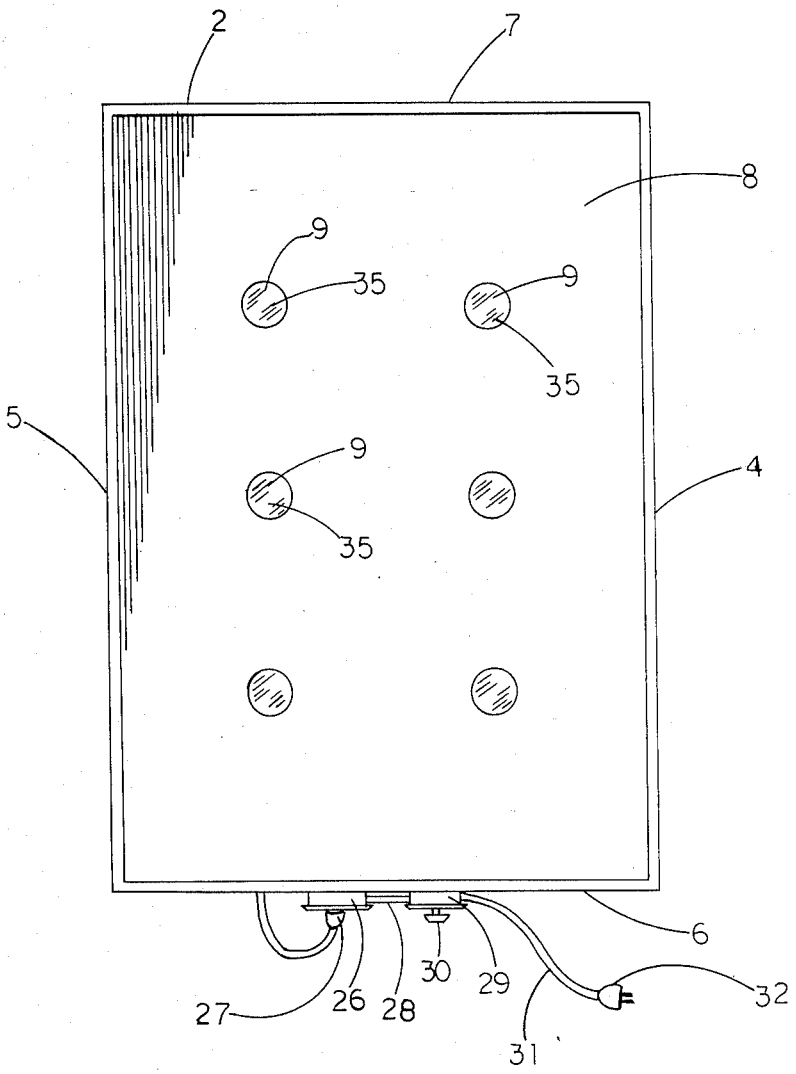
FIG. 3 is a top plan view of the rectangular mattress box of the water bed shown in FIG. 1 but with the mattress removed.
Figure 4:
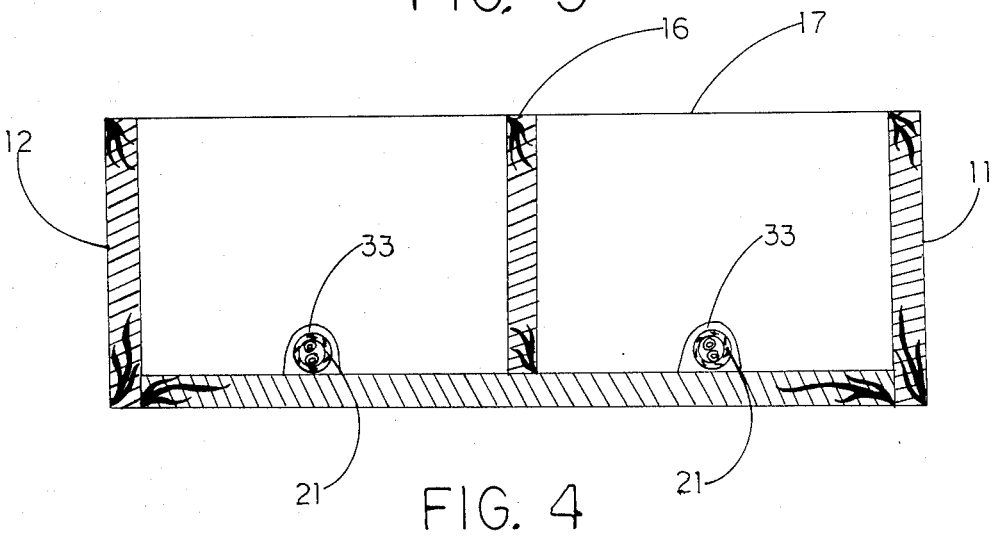
FIG. 4 is a section view taken on line 4—4 of FIG. 2.
Figure 5:
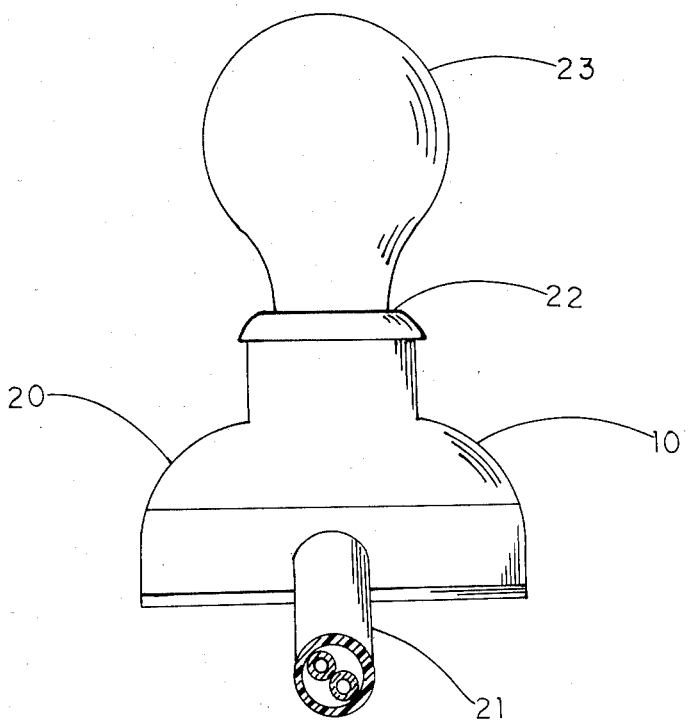
FIG. 5 is a side elevation view of one of the lighting fixtures for use in the water bed shown in FIG. 1.

An illuminated water bed in accordance with this invention includes transparent water mattress 1, received in a rectangular mattress box 2, supported on a rectangular base 3.

The water mattress 1 is of conventional transparent flexible sheet material impervious to water, formed into a rectangular water tight container to form a rectangular mattress for sleeping thereon when filled with water.

The rectangular mattress box 2 includes elongated side walls 4 and 5, and shorter end walls 6 and 7, end wall 6 being at the head end of the bed and end wall 7 being at the front end. The mattress box 2 also includes a floor or bottom wall 8 having spaced apart holes or apertures 9 formed therein and located to be in registration with respective ones of lighting fixtures 10 placed in similarly spaced apart locations in the rectangular base 3.

The rectangular base 3 is somewhat smaller in both lateral and longitudinal dimension than the rectangular mattress box 2. Rectangular base 3 includes elongated side walls 11 and 12, an end wall 13 at the head end and an end wall 14 at the foot end, and a bottom wall 15.

A centrally located support wall 16 extends longitudinally of the base 3 from the head end wall 13 to the foot end wall 14, spaced apart equidistantly from each side wall 11 and 12. A first lateral support wall 17 extends laterally across the base 3 from side wall 11 to side wall 12, spaced apart from the head end wall 13 a distance substantially equal to one-third of the distance between head end wall 13 and the foot end wall 14. A second lateral support wall 18 extends laterally across the base 3 from side wall 11 to side wall 12, spaced apart from the foot end wall 14 a distance substantially equal to one-third of the distance between foot end wall 14 and head end wall 13. The spaced apart distance between lateral support walls 17 and 18 is therefore also substantially equal to one-third the distance between the end walls 13 and 14. The lateral support walls 17 and 18 and the central longitudinal support wall 16 form six separated compartments 19.

Each lighting fixture 10 includes a base 20, an electrical conduction 21 electrically connected thereto, and a socket 22 to receive a light bulb 23. The lighting fixtures 10 are connected in series to the electrical conductor 21 which in turn is connected to a junction box 24 mounted on the head end wall 13 of the base 3, from which an extension cord 25 extends, being connected in the junction box 24 to the conductor 21.

The extension cord 25 is long enough to reach the outlet box 26 mounted on the head end wall 6 of the mattress box 2, the extension cord 25 having a plug 27 for plugging into the outlet box 26. The outlet box 26 is connected by a short conductor 28 to a dimmer switch box 29, having dimmer switch control 30 thereon, the dimmer switch box being also mounted on the head end wall 6 of the mattress box 2. A second extension cord 31 extends from the dimmer switch box 29, being connected therein to the short conductor 28, the extension cord 31 being long enough for its plug 32 to reach a room wall outlet. When plugged into a wall outlet, the electrical lighting circuit as described may then be energized and controlled by the dimmer switch control 30 to turn the bulbs 23 in lighting fixtures 10 off and on, and to varying degrees of light intensity in between.

One lighting fixture 10 is located centrally of each compartment 19. Apertures 33 are formed along the bottom edges of the lateral support walls 17 and 18 at about the mid-line of each compartment 19, through which the conductor 21 extends from one compartment 19 to the next. The lighting fixtures 10 are positioned in each compartment 19 to lie directly beneath a corresponding one of the apertures or holes 9 in the floor or bottom wall 8 of the mattress box 2. At such time the lighting fixtures 10 are also in line with corresponding ones of apertures 34 in the side walls 11 and 12 of the base 3, each aperture 34 opening to a one of the compartments 19.

The apertures 9 in the bottom wall 8 of the mattress box 2 are covered by plexiglas lens 35 affixed to the underside of the bottom wall 8 by any conventional means. The plexiglas lens 35 may be clear, or they may be colored, and different ones may have different colors.

The apertures 34 in the side walls 11 and 12 of the base 3 are covered by glass lens 36, or lens or covers of other transparent material, and are affixed in place over the apertures 34 by any conventional means. The glass lens 36 may also be clear, or they may be colored, and different ones may have different colors.

The lighting fixtures 10 need not be permanently affixed to the bottom wall 15 of the base 3, but may be loosely placed thereon free to be moved freely as desired within each one's compartment 19. A preferred location is directly beneath the respective aperture or hole 9 in the bottom wall 8 of the mattress box 2 which corresponds to and overlies each compartment 19 in the base 3, at which time the lighting fixture 10 is also in axial alignment with a corresponding one of the apertures 34 in the side walls 11 and 12 of the base 3.

I claim:

1. An illuminated water bed, comprising a base member having oppositely disposed base side walls, a mattress holder having a bottom wall resting on top of said base member, a water mattress in said holder resting on said bottom wall thereof, said water mattress being a water tight container of transparent flexible sheet material, a plurality of first apertures in said bottom wall of said mattress holder in spaced apart relationship, a first light emitting device positioned between said side walls of said base member and in a first location to transmit light therefrom through a first one of said plurality of said first apertures, and a second light emitting device positioned between said side walls of said base member and in a second location spaced apart from said first location to transmit therefrom through a second one of said plurality of said first apertures, whereby said water mattress is illuminated from light transmitted through said plurality of first apertures.

2. An illuminated water bed as set forth in claim 1, including a plurality of second apertures, a first one of said plurality of second apertures being located in a first one of said base side walls, a second one of said plurality of second apertures being located in a second one of said base side walls, said first one of said second apertures being in light transmitting communication with one of said light emitting devices to illuminate an area outside of and adjacent to said first one of said base side walls, said second one of said second apertures being in light transmitting communication with the other of said light emitting devices to illuminate an area outside of and adjacent to said second one of said base side walls.

3. An illuminated water bed as set forth in claim 2, wherein said base member includes a longitudinally extending support wall substantially parallel to said base side walls and located substantially midway between them, said first light emitting device being located in the space between said first one of said base side walls and said longitudinal support wall, said second light emitting device being located in the space between said second one of said base side walls and said longitudinal support wall.

4. An illuminated water bed as set forth in claim 3, wherein said base member includes a first laterally extending support wall from said first to said second one of said base side walls, said first laterally extending support wall intersecting said longitudinally extending support wall, thereby forming a first base compartment between said first one of said base walls bounding one side, said longitudinal support wall bounding the opposite side, and one side of said first lateral support wall bounding a third side, a second base compartment between said second one of said base walls bounding one side, said longitudinal support wall bounding the opposite side, and said one side of said first lateral support wall bounding said third side, a third base compartment between said first one of said base walls bounding one side, said longitudinal support wall bounding the opposite side, and the other side of said first lateral support wall bounding a third side, and a fourth base compartment between said second one of said base walls bounding one side, said longitudinal support wall bounding the opposite side, and the said other side of said first lateral support wall bounding a third side, said first one of said first apertures in said bottom wall of said mattress holder being positioned over said first base compartment, said second one of said first apertures being positioned over said second base compartment, said plurality of first apertures including a third one of said first apertures positioned over said third base compartment and a fourth one of said first apertures positioned over said fourth base compartment, said first light emitting device being in said first base compartment positioned to transmit light therefrom through said first one of said first apertures, said second light emitting device being in said second base compartment positioned to transmit light therefrom through said second one of said first apertures, a third light emitting device, said third light emitting device being in said third base compartment positioned to transmit light therefrom through said third one of said first apertures, and a fourth light emitting device, said fourth light emitting device being in said fourth base compartment positioned to transmit light therefrom through said fourth one of said first apertures.

5. An illuminated water bed as set forth in claim 4, wherein said base member includes a second laterally extending support wall from said first to said second one of said base side walls, said second laterally extending support wall intersecting said longitudinally extending support wall and being spaced apart longitudinally from said first laterally extending support wall, one side of said second laterally extending support wall bounding said third and fourth base compartments on fourth sides thereof, fifth and sixth base compartments being bounded along one of their sides by the other side of said second laterally extending support wall, said fifth base compartment being bounded along its outer wall by said first one of said base walls and along its inner wall by said longitudinal support wall, said sixth base compartment being bounded along its outer wall by said second one of said base walls and along its inner wall by said longitudinal support wall, said plurality of first apertures including a fifth one of said first apertures positioned over said fifth compartment and a sixth one of said first apertures positioned over said sixth compartment, a fifth light emitting device, said fifth light emitting device being in said fifth base compartment positioned to transmit light therefrom through said fifth one of said apertures, a sixth light emitting device, said sixth light emitting device being in said sixth base compartment positioned to transmit light therefrom through said sixth one of said apertures.

6. An illuminated water bed as set forth in claim 5, wherein one of said base member is the head end and the opposite end is the foot end, said first laterally extending support wall being spaced apart longitudinally from said head end in the direction toward said foot end substantially one-third of the distance between said head end and said foot end, said second laterally extending support wall being spaced apart longitudinally from said foot end in the direction toward said head end substantially one-third of the distance between said head end and said foot end, said foot and second laterally extending support walls being also spaced apart from each other substantially one-third of said distance between said head end and said foot end of said base member, said first and second laterally extending support walls being substantially parallel to each other and substantially normal to said longitudinally extending support wall and to said first and second ones of said base side walls, said base compartments being of substantially equal dimensions each having a central midpoint, a respective one of said first apertures in said bottom wall of said mattress holder being in registration with the said central midpoint of a corresponding one of said base compartments.

7. An illuminated water bed as set forth in claim 6, wherein said first one of said plurality of second apertures in said first one of said base side walls opens to said first base compartment, said second one of said plurality of second apertures in said second one of said base side walls opens to said second base compartment, said plurality of second apertures including a third aperture in said first one of said base side walls opening to said third base compartment, a fourth one of said second apertures in said second one of said base side walls opening to said fourth base compartment, a fifth one of said second apertures in said first one of said base side walls opening to said fifth base compartment, a sixth one of said second apertures in said second one of said base side walls opening to said sixth base compartment.

8. An illuminated water bed as set forth in claim 7, wherein said central midpoint of each of said base compartments is in alignment with the central axis through the respective one of said apertures in said second plurality of apertures which opens thereto.

9. An illuminated water bed as set forth in claim 1, wherein said light emitting devices include an electrical fixture comprising a base, a socket to receive an electric light bulb, and said electric light bulb, an electrical conductor connecting said electrical fixtures, to an electrical supply source, and switch means to energize and deenergize said electrical fixtures and said electric light bulbs received therein.

10. An illuminated water bed as set forth in claim 9, wherein said switch means includes a dimmer switch and a dimmer switch control to control the intensity of light transmitted from said electric light bulbs between none and full capacity and any level of intensity in between.

11. An illuminated water bed as set forth in claim 1, wherein said plurality of first apertures include transparent coverings over said apertures.

12. An illuminated water bed as set forth in claim 11, wherein said transparent coverings are colored, and are of a single color.

13. An illuminated water bed as set forth in claim 11, wherein said transparent coverings are colored, and each are of a different color.

14. An illuminated water bed as set forth in claim 2, wherein said plurality of second apertures include transparent coverings over said apertures.

15. An illuminated water bed as set forth in claim 14, wherein said transparent coverings are colored, and are of a single color.

16. An illuminated water bed as set forth in claim 14, wherein said transparent coverings are colored, and each are of a different color.

17. In a water bed having a flexible, transparent water bed mattress, the improvement being an illumination assembly comprising:

a mattress holder with bottom and at least one sidewall for containing said transparent water bed mattress and having at least one aperture in the bottom for passage of light therethrough to illuminate any water contained in the mattress;

a base having opposite disposed base sidewalls supporting the holder;

a source of illumination; and means for mounting the source of illumination to the base between said opposite disposed base sidewalls and beneath the bottom in light communication with the water mattress through said aperture.

* * * * *

UNITED STATES PATENT AND TRADEMARK OFFICE

CERTIFICATE OF CORRECTION

PATENT NO. : 4,742,437

DATED : May 3, 1988

INVENTOR(S) : Rick Downey

It is certified that error appears in the above-identified patent and that said Letters Patent is hereby corrected as shown below:

Col. 2, line 14, change "front" to --foot--;

Col. 3, line 49, after "transmit" insert --light--; and

Col. 5, line 21, change "foot" (second occurrence) to --first--.

Signed and Sealed this

Twenty-fifth Day of October, 1988

*Attest:*

*Attesting Officer*

DONALD J. QUIGG

*Commissioner of Patents and Trademarks*